United States Patent [19]

O'Connor

[11] 4,028,758

[45] June 14, 1977

[54] COMBINATION UTILITY KNIFE AND STAPLE REMOVER

[76] Inventor: John J. O'Connor, 26412 Via del Sol, Mission Viejo, Calif. 92675

[22] Filed: Sept. 22, 1975

[21] Appl. No.: 615,346

[52] U.S. Cl. ..... 7/14.1 R; 30/162; 254/28

[51] Int. Cl.[2] ..... B25F 1/04; B26B 11/00

[58] Field of Search ..... 7/1 B, 1 R, 14.1 R; 30/162, 333, 335, 339; 254/28

[56] References Cited

UNITED STATES PATENTS

| | | | |
|---|---|---|---|
| 2,474,609 | 6/1949 | Wolf | 30/162 |
| 2,563,227 | 8/1951 | Emery | 254/28 |
| 2,607,987 | 8/1952 | Bettenhausen | 30/162 X |
| 3,107,426 | 10/1963 | Robinson, Jr. | 30/162 |
| 3,299,449 | 1/1967 | Olney | 30/2 |
| 3,613,134 | 10/1971 | Bassett | 7/14.1 R |
| 3,906,627 | 9/1975 | Manning | 30/162 |

*Primary Examiner*—Al Lawrence Smith
*Assistant Examiner*—Roscoe V. Parker

[57] ABSTRACT

A utility knife and staple remover in combination, wherein the device comprises a split housing designed to be held in the palm of the hand, whereby a slidable, spring-biased, cutter blade is disposed therein, the blade being arranged to lock in a positive manner in either an extended mode or a retracted mode wherein a coil spring causes full retraction of the blade when released from the locked, extended mode. Secured to the knife housing is a staple remover having a concave/convex, lever-aim member, whereby the staple remover can be rocked from side to side when the prongs thereof are engaged with a fixed staple to be removed from a fixture.

1 Claim, 6 Drawing Figures

COMBINATION UTILITY KNIFE AND STAPLE REMOVER

BACKGROUND OF THE INVENTION

1. Field of the Invention

This invention relates to devices for opening cartons and the like having either staples thereon and/or sealed with tape and, more particularly, to the combination of a utility knife having a staple remover formed therewith as a single unit.

2. Description of the Prior Art

As is well known in the art, various problems and difficulties are encountered in providing suitable means for opening sealed cartons, particularly large cardboard boxes and the like. Generally, these boxes, or cartons, are sealed with special tapes that are very difficult to remove in order to open the cartons without damage thereto. Then again, many boxes are fastened in a closed or sealed manner by a plurality of large staples.

Several carton-and-box-opening devices have been devised and are now in use. However, they are designed specifically to cut the tape or to remove staples. That is, to the inventor's knowledge, there is no existing device that combines the needed components to provide a simple, single tool that will both cut the tape and remove staples.

The staple-removing devices as are now in use generally cause considerable damage to many reusable types of cartons and boxes. The existing devices have a tendency to tear, rip, or puncture holes in otherwise perfectly good, reusable, shipping containers. Most staple removers are designed to engage staples and pull them out in a crow-bar action.

Further, the utility knives as presently known do not provide a safety means by which the blade will automatically retract when released from an extended, operating mode.

Therefore, the present invention as hereinafter described will be understood to answer the above problem.

SUMMARY OF THE INVENTION

The present invention comprises a utility knife in combination with a staple remover of the type used in fastening cardboard boxes and shipping containers, wherein the device includes a split housing held together by fastening screws, hence allowing each section of the housing to be separated, whereby cutting blades slidably disposed therein can be readily changed when no longer usable.

The blade is removably coupled to a slidable bracket having a retraction spring mounted thereto. This spring provides a means by which the cutting blade can be automatically retracted when the bracket is manually released from a locked-open mode of operation. When the blade is pulled within the housing, it locks into a fully-retracted position, whereby the blade is totally hidden.

Secured to one side of the housing is a staple remover having a plurality of forked tongues adapted to be positioned over and under a staple to be removed from a carton. The staple remover comprises a single, elongated member having one end secured to the housing thereof in a parallel plan thereto, and extending outwardly and rearwardly, whereby the outer, forked end is bent at a substantially 60° angle thereto. In addition, the extended portion of the elongated member between the housing and forked end is shaped so as to form a substantially convex/concave, central body, whereby the tongues can be pivoted thereon in a side-to-side movement. Hence, a staple can be removed under less strain, thereby causing very little damage, if any, to the structure of the box to which the staple is fastened.

OBJECTS AND ADVANTAGES OF THE INVENTION

The present invention has for an important object a provision wherein a carton-opening device includes both a utility knife for cutting taped boxes and a staple remover so designed as not to damage reusable shipping containers when the staples therein are removed therefrom.

It is another object of the invention to provide a combination utility knife and staple remover wherein the staple-removing member is so arranged so as to be allowed to pivot from side to side when engaged with a staple to be removed, whereby the staple is more readily extracted therefrom without tearing the cardboard.

It is still another object of the invention to provide a combination utility knife and staple remover wherein a safety feature is included, whereby the blade disposed therein is automatically retracted by a biasing-spring means.

It is a further object of the present invention to provide a combination utility knife and staple remover that is easy to service and maintain.

It is still a further object of the invention to provide a device of this character that is relatively inexpensive to manufacture.

Still another object of the invention is to provide a device of this character that is simple and rugged in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figures 1, 2, 3, 4, 5, 6, 7:
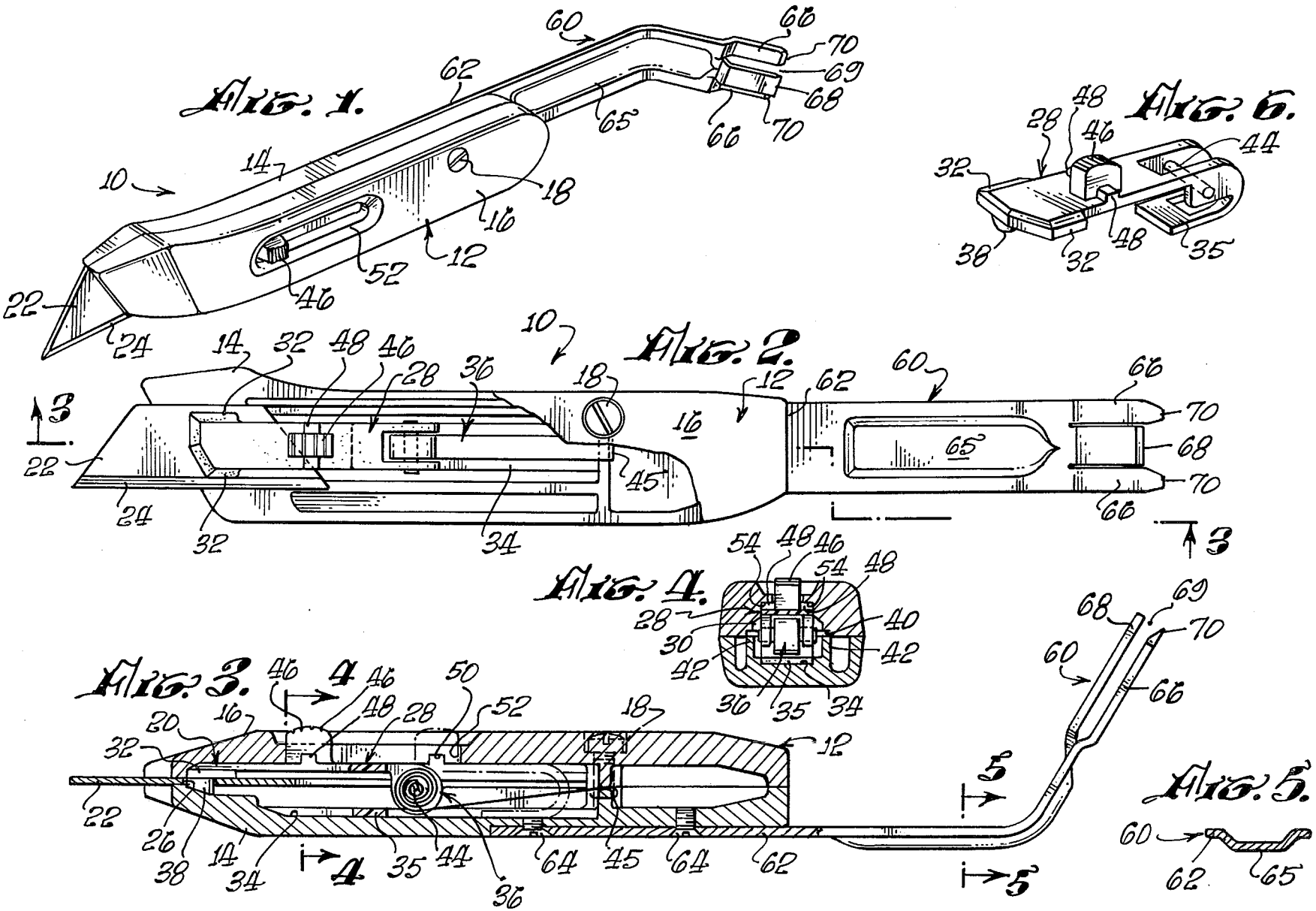
FIG. 1 is a perspective view of the present invention.
FIG. 2 is a side-elevational view of the invention having a portion of the housing thereof broken away to illustrate the interior thereof.
FIG. 3 is a cross-sectional view taken substantially along line 3—3 of FIG. 2 thereof.
FIG. 4 is a cross-sectional view taken substantially along line 4—4 of FIG. 3.
FIG. 5 is a cross-sectional view taken along line 5—5 of FIG. 3.
FIG. 6 is a perspective view of the cutting blade-mounting bracket.

Referring more particularly to FIG. 1, there is shown a tool forming a combination utility knife and staple remover which is generally indicated at 10. This tool comprises a main housing 12 formed by split sections 14 and 16, respectively. Split section 14 will hereinafter be referred to as the bottom section and section 16 as the top section. Both sections are removably mounted together by a machine screw 18, or any other suitable fastening means, whereby each half of the housing can be readily separated.

When mounted together, the sections define a compartment designated at 20, wherein a typical, well-known cutting blade 22 is slidably received therein. The blade 22 includes a razor-sharp edge 24 and an opening 26 centrally disposed therein, as seen in FIG. 3.

Accordingly, the blade 22 is removably attached to a slidable bracket, indicated generally at 28 and clearly illustrated in FIG. 6. This bracket is formed from a very tough, yet pliable, plastic material and is adapted to be slidably received between the two sections 14 and 16 in compartment 20. Thus, to provide a means to guide and align the bracket 28 therein, there is formed in the top section 16 a channel 30, which accommodates tabs 32 of bracket 28, tabs 32 being formed along the forward edges thereof, and a second channel 34 arranged in the bottom section 14. Said channel 34 is formed to accommodate the bracket base member 35; thus, the tabs 32 and base 35 slide along channels 30 and 34, respectively, in a longitudinal manner. Since the blade is attached to bracket 28 the blade is then moved outwardly to an extended, cutting position or allowed to be retracted when the bracket is biased rearwardly by biasing means 36, the blade being attached to bracket 28 by a downwardly extending nipple 38 which is received in opening 26 of the blade 22, as seen in FIG. 3. It should be mentioned that blade 22 is also provided with and received in a track 40 formed in top section 16 and slidably held therein by ribs 42 of the bottom section 14.

The biasing means for retracting said blade and bracket comprises a coil spring having one end thereof connected to said bracket 28 by pin 44 and the opposite end connected to the bottom section 14, as indicated at 45.

When the blade is to be extended as shown, finger plug 46 of bracket 28 is pressed downwardly to allow stop means 48, also a part of bracket 28, to be disengaged from rear notch 50 disposed in top section 16 adjacent channel 30, wherein plug 46 is moved forward in slot 52 formed in said top section 16. The plug 46 is moved forward and abuts against the end of slot 52, at which time lock means 48 is allowed to enter forward notch 54, thereby locking blade 22 in and extended, operating mode.

To retract the blade 22, one simply pushes down on plug 46, thereby disengaging lock means 48 from notch 54, at which time spring 36 pulls the bracket rearwardly and automatically locks in notch 50, wherein a safety means is provided within the tool. Said lock means comprises a pair of ears integrally formed in said support bracket 28.

It is contemplated that additional notches can be arranged to provide various extended blade positions, if necessary.

Fixedly secured to the bottom section 14 is a staple-removing means, generally indicated at 60. Said staple-removing means comprises an elongated, substantially-flat bar 62 which is secured to section 14 by fastening means indicated as screws 64. The bar extends rearwardly, at which point the flat bar is formed with a convex/concave, body portion 65 and is bent inwardly at an approximate 60° angle thereto, wherein the free end thereof forms a plurality of forked tongues. The tongues are arranged wherein the two side tongues 66 and the central tongue 68 are bent outwardly from each other, thereby providing space 69 therebetween to receive staples to be removed from a shipping container. Each lower or side tongue 66 includes a wedge end 70 which is adapted to be readily forced under the staple.

Once the staple is positioned between the tongues, the tool is then rocked from side to side, using the convex surface of body portion 65 as a pivoting means. Thus, the staple can be removed in an end-to-end relationship with the cardboard, rather than being pulled directly upward as if using a crowbar. It has been found that the crowbar action tends to damage the containers wherein they can not be reused.

I claim:

1. In combination, a utility knife and staple remover wherein the knife portion includes a cutting blade therein, said combination comprising:

a split housing having removable top and bottom sections, said sections forming a compartment therebetween, said top section having a longitudinal slot disposed therein;

means for removably securing said top and bottom sections together;

a blade-support bracket having a base member integrally formed therewith and including extending tab members, said bracket being formed of a flexible material and including a plug arranged to be received in said slot of the top section; and wherein said bracket is slidably disposed for longitudinal movement within said compartment, and a spring mounting pin affixed rearwardly thereof;

biasing means attached to said blade-support bracket to automatically retract said blade attached to said bracket, wherein said biasing means comprises a coiled spring having one end connected to said support bracket and the opposite end thereof connected to said housing, and wherein said mounting pin is mounted to said bracket having the coiled portion of said spring affixed thereto;

locking means arranged between said support bracket and one of said sections, whereby said blade is locked into a predetermined position wherein said locking means comprises:

a plurality of notches arranged in the upper section of said housing, at least one of said notches being a forward notch and one being a rearward notch; and a pair of ears integrally formed in said support bracket arranged to be received in said notches;

staple-removing means secured to one of said sections, said means including pivoting means whereby said staple-removing means is rotated thereon in a side-to-side movement when removing a fixed staple, wherein said staple-remover means comprises:

an elongated, substantially-flat, metal bar secured to said bottom section of said housing, said bar being bent at an obtuse angle relative to said housing;

three forked tongues formed in one end of said bar, the central tongue being offset outwardly from the remaining side tongues, said side tongues having wedge-shaped ends formed thereon, wherein said pivoting means comprises a convex/concave body portion formed longitudinally in said bar, whereby said staple-remover is pivoted from side-to-side when removing staples, and wherein said top and bottom sections of said housing include longitudinal channels therein forming guides, whereby said extended tabs of said support bracket are slidably disposed in respective guides and wherein a track is arranged between said sections to slidably receive said cutting blade therein.

* * * * *